United States Patent [19]

Kume

[11] Patent Number: 4,946,006

[45] Date of Patent: Aug. 7, 1990

[54] ELEVATOR APPARATUS WITH A SECTORED VERTICAL SHAFT AND A TURNTABLE FOR TRANSFERING ELEVATOR CAGES BETWEEN THE INDIVIDUAL SECTORS

[75] Inventor: Takeshi Kume, Amagasaki, Japan

[73] Assignee: T. K. M. Engineering Kabushiki Kaisha, Amagasaki, Japan

[21] Appl. No.: 337,552

[22] Filed: Apr. 13, 1989

[30] Foreign Application Priority Data

Apr. 13, 1988 [JP] Japan ..... 63-91999

[51] Int. Cl.[5] ..... B66B 11/04

[52] U.S. Cl. ..... 187/25; 414/263; 182/82; 182/141

[58] Field of Search ..... 187/1 R, 17, 19, 24, 187/25, 6; 414/263; 182/82, 141, 147

[56] References Cited

U.S. PATENT DOCUMENTS 511,679 12/1893 Buckley ..... 187/24

4,265,581 5/1981 Ives et al. ..... 414/263 X 4,594,044 6/1986 Soot ..... 414/263

*Primary Examiner*—Andres Kashnikow

*Assistant Examiner*—K. DeRosa

*Attorney, Agent, or Firm*—Marshall, O'Toole, Gerstein, Murray & Bicknell

[57] ABSTRACT

This disclosure relates to an elevator system for use in a multi-story building, the building having a vertical space formed therein. The elevator system comprises a stationary framework adapted to be mounted in the space, the framework comprising frame members dividing the vertical space into a plurality of angularly spaced sectors. At least one elevator cage is mounted each of the sectors. At least one turntable is rotatably mounted in the space adjacent the stationary framework, the turntable being located to receive a cage from the stationary framework and rotate the cage from one of the sectors to another of the sectors. A power drive on the frame members, the turntable and on each cage is provided for moving each cage in the vertical direction.

4 Claims, 9 Drawing Sheets

11a
12a
39
38
37
70
28
25
4
78
26
29
4B
13a
12
13
92
7
33
35
36
32
34
95
4C

ELEVATOR APPARATUS WITH A SECTORED VERTICAL SHAFT AND A TURNTABLE FOR TRANSFERING ELEVATOR CAGES BETWEEN THE INDIVIDUAL SECTORS

FIELD AND BACKGROUND OF THE INVENTION

This invention relates to an elevator including multiple elevator cages which ascend and descend in a cylindrically shaped elevator support.

Conventional elevators usually have a winding drum located in the uppermost section of a support having a rectangular cross section, the drum being connected by a cable to the cage. These elevators transport passengers or freight by winding and unwinding the cable in order to raise and lower the cage suspended from the cable.

However, recent trends show a continuing proliferation of high-rise buildings. If, for example, the number of stories in a building is tripled and the speed, passenger capacity, and number of the elevators remains unchanged, the traffic capacity is reduced to one-third the original level. The measures which have heretofore been undertaken to correct this problem have been to increase the speed of the elevators, and/or increase the size of the cages to create larger passenger capacities, and/or increase the number of the elevators.

If the elevator speed is increased to correct the problem, because the riding comfort decreases as the rate of acceleration increases, the rate of acceleration is normally limited to 0.75 m/sec$^2$.

At a rate of acceleration of 0.75 m/sec$^2$, the acceleration distances (in meters) required to reach the speeds of 100 m/min, 150 m/min, 300 m/min, and 600 m/min from a standstill are 1.85 m, 4.16 m, 16.65 m, and 66.65 m, respectively. If the height of one story is assumed to be 3.3 m, the acceleration distance required to reach a speed of 300 m/min from a standstill is equivalent to 5.0 stories, and the acceleration distance required to reach a speed of 600 m/min from a standstill is equivalent to a 20.2 stories.

With a high-speed elevator capable of running at a speed of 600 m/min, when traveling up to the high level of the 40th floor, half of the time is spent accelerating, and the remaining half of the time is spent decelerating. Thus, the 10 passengers are subjected to either acceleration or deceleration throughout their time on the elevator, resulting in poor riding comfort. Furthermore, the high-speed function can seldom be accomplished. The elevator's high speed of 600 m/min is effective only in the very limited case of non-stop operation to very high levels above the 40th floor, and thus there is no multipurpose usefulness.

With either the method of increasing the passenger capacity by enlarging the size of the elevator cages or the method of increasing the number of elevators, the amount of building space which must be allotted to the elevators increases, which decreases the usable business or living space of the building and reduces the efficiency of either method. Note also that the method of enlarging the size of the elevator cages does not necessarily lead to a reduction of the waiting time.

FIG. 8 of the drawings shows a comparison of the ascent-descent times with respect to the building height when the speed of the elevator cage is changed. The height of the building is shown on the horizontal axis and the round-trip ascent-descent time is shown on the vertical axis. Because the percentage of time required for acceleration increases as the speed increases, the limit for high-rise buildings of 30 stories or less is a speed of approximately 150 m/min, due to the inability to make sufficient use of a high-speed function.

In consideration of the problem described above, the objective of this invention is to propose an efficient elevator system for which the waiting time is substantially reduced without increasing the number of elevators.

SUMMARY OF THE INVENTION

An elevator system in accordance with this invention is for use in a multi-story building, the building having a vertical space formed therein. The elevator system comprises a stationary framework adapted to be mounted in said space, said framework comprising frame members dividing said vertical space into a plurality of angularly spaced sectors. At least one elevator cage is movably mounted in each of said sectors. At least one turntable means is rotatably mounted in said space adjacent said stationary framework, said turntable means being located to receive a cage from said stationary framework and rotate said cage from one of said sectors to another of said sectors. Power means is provided on said frame members, said turntable means and each cage for moving each cage in the vertical direction.

BRIEF DESCRIPTION OF THE DRAWINGS

The following is a description of a preferred embodiment of this invention with reference to the attached drawings, wherein.

Figure 4:
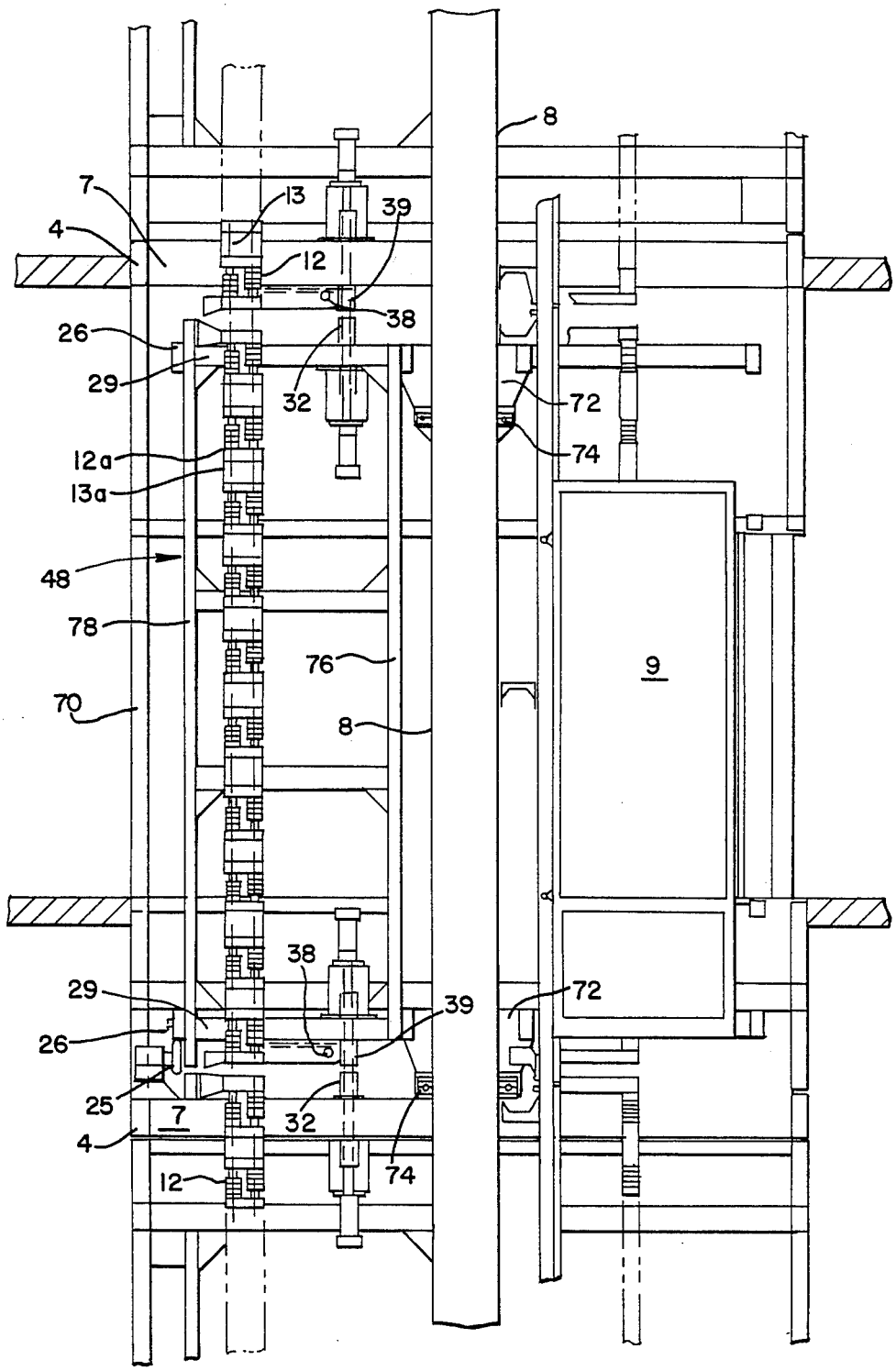
Figures 4A, 4B, 4C:
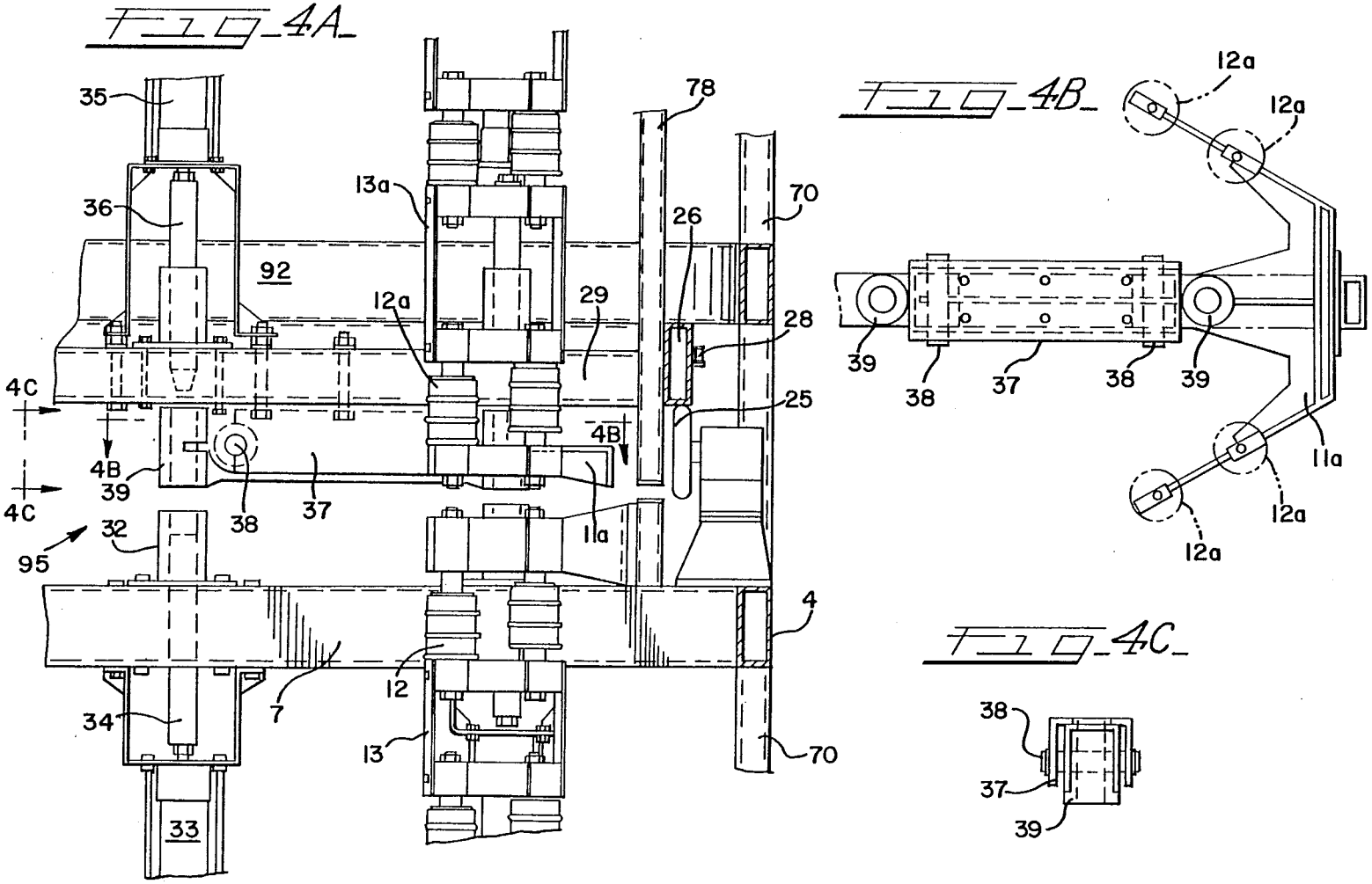
Figure 5:
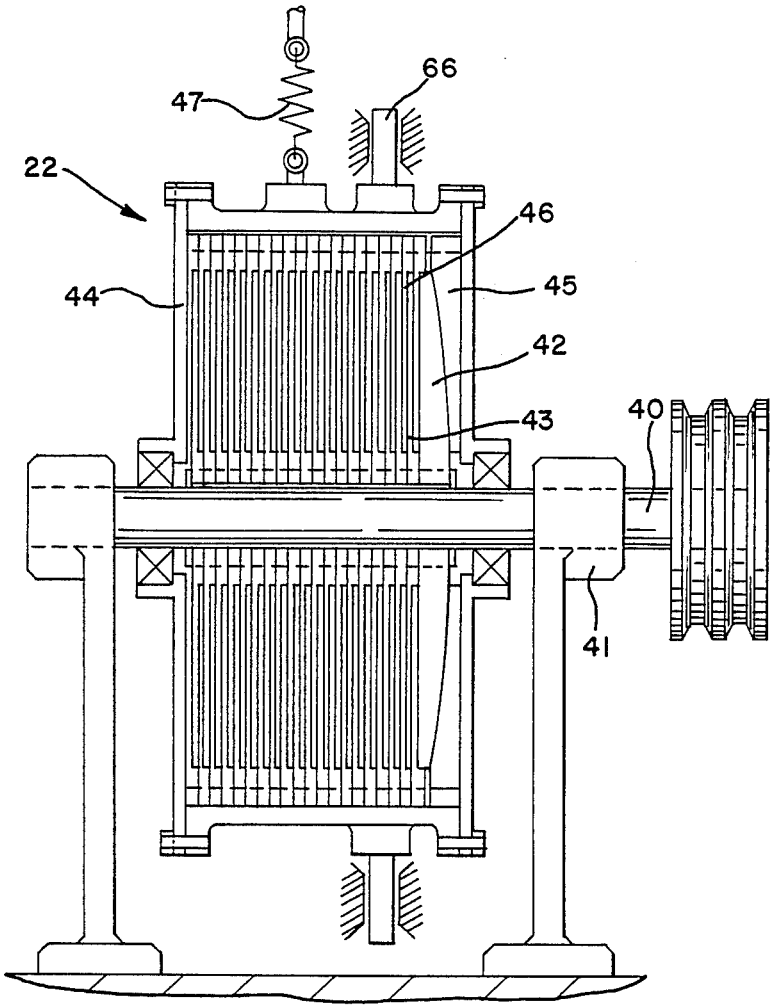
Figure 6:
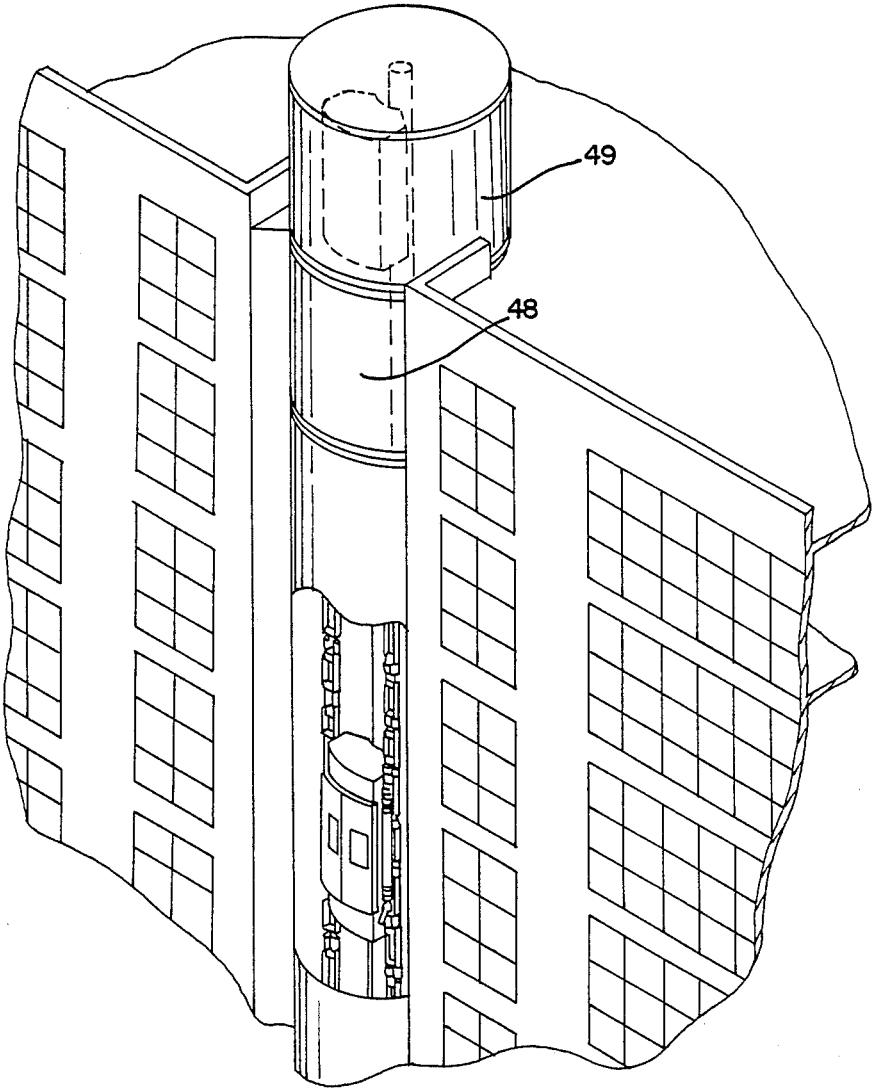
Figure 7D:
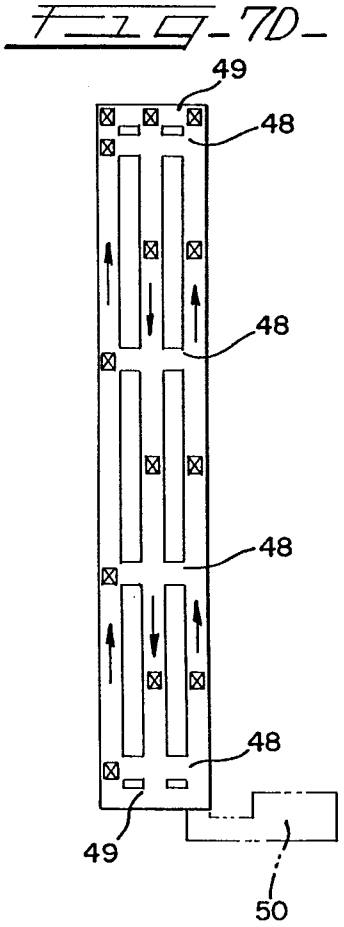
Figure 7C:
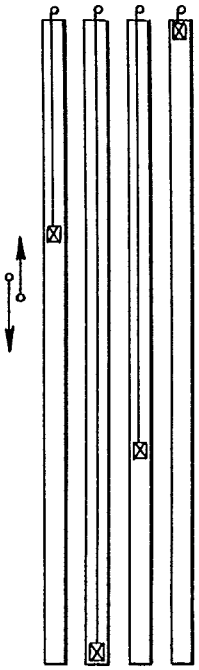
Figure 7B:
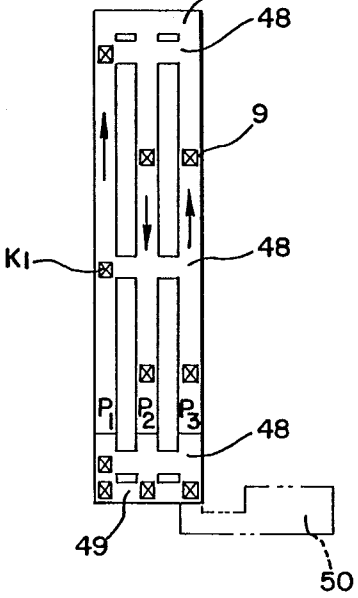
Figure 7A:
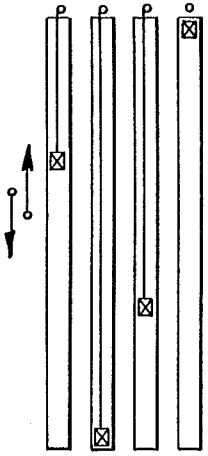

Fib. 3B is a view showing part of the drive;

FIG. 4 is an axial view of the elevator system;

FIG. 4A shows a side view of the flanged roller unit positioning device for the cage transfer table;

FIG. 4B shows a cross-sectional view along plane 4B—4B in FIG. 4A;

FIG. 4C is a view taken on the line 4C—4C of FIG. 4A;

FIG. 5 shows a vertical cross-sectional view of a slide brake of the system;

FIG. 6 shows a fragmentary perspective view of the system installed in a building;

FIG. 7A and 7B are schematic diagrams of a conventional cable type and this invention, respectively, in a 20-story building.

Figure 8:
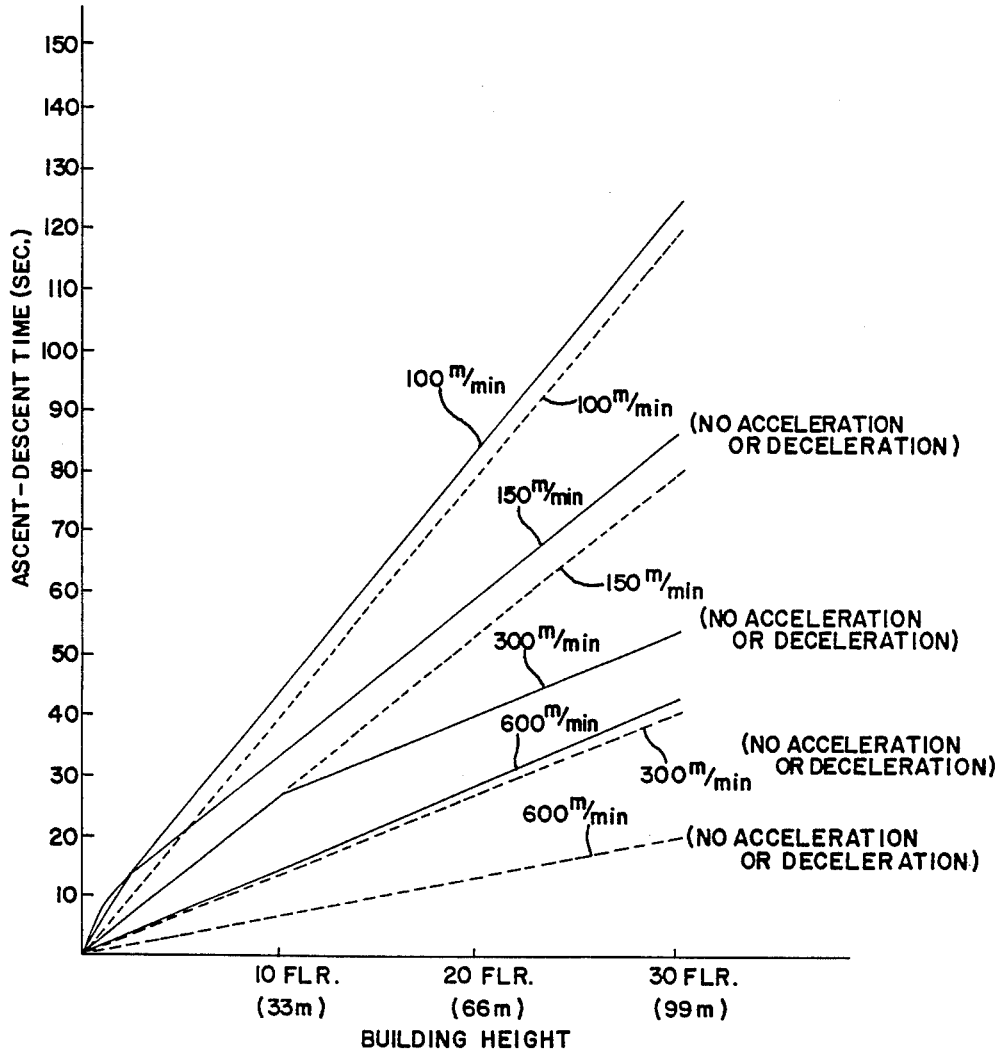

FIGS. 7C and 7D are views similar to FIGS. 7A and 7B, but in a 30 story building; and FIG. 8 shows curves illustrating a comparison of the ascent-descent times of conventional elevators with respect to the building height.

DETAILED DESCRIPTION OF THE DRAWINGS

Figure 1A:
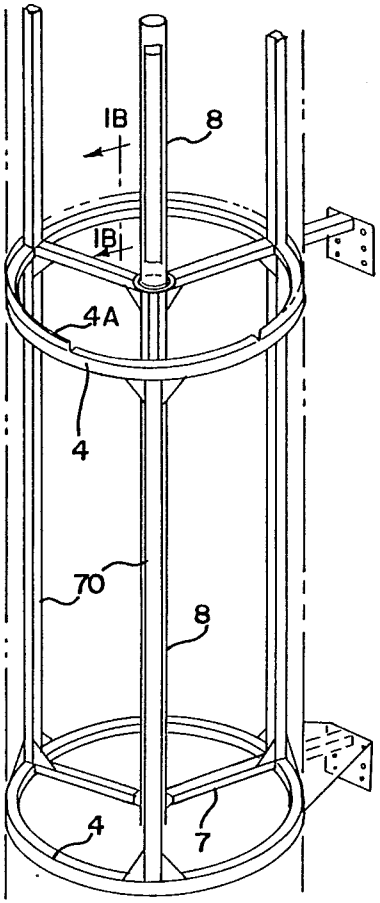
FIG. 1A is a perspective view of framework of the elevator system.
Figure 1B:
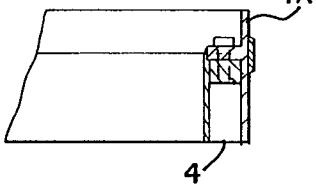
FIG. 1B is a sectional view taken on the line 1B—1B of FIG. 1A.
Figure 1:
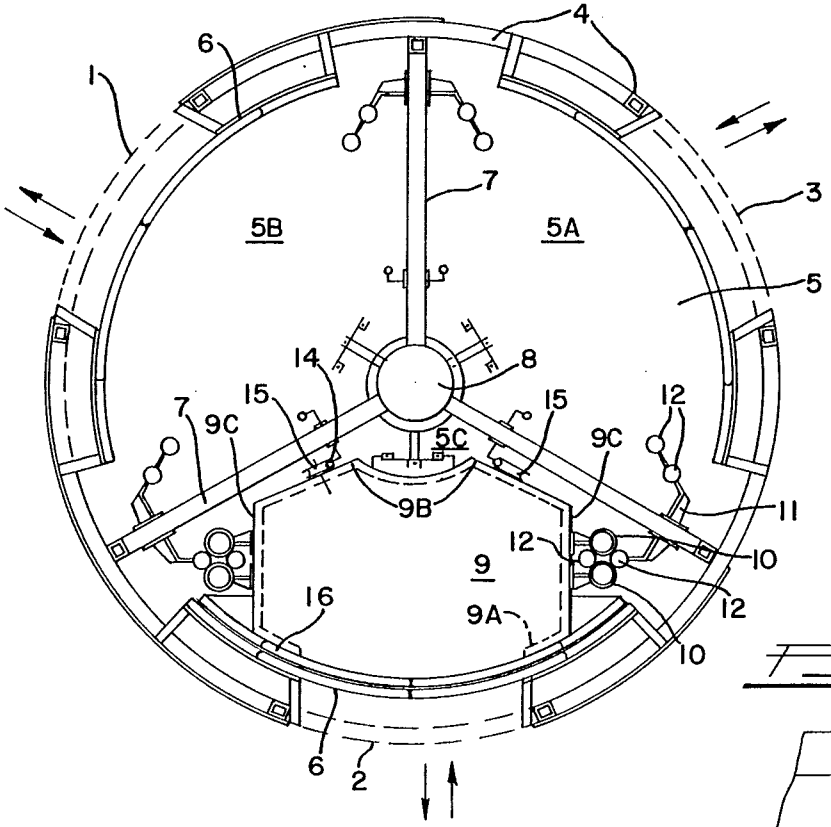
FIG. 1 shows a horizontal cross-sectional view of an elevator system according to this invention.

In FIG. 1, the numerals 1, 2 and 3 are door openings formed in a frame 4 which extends from the bottom to the top of the inside of a cylindrical elevator shaft or space 5 in a multiple-floor building (not shown). Doors 6 which slide open and closed in the circumferential direction are installed on the frame 4 at each floor of the building. Partition members 7 extend horizontally and radially between the frame 4 and an axially located central post 8. In this example, there are three members 7 at intervals of 120° in order to divide the cylindrical space 5 into three sections or sectors 5A, 5B and 5C.

Within each section 5A, 5B and 5C is movably mounted an elevator cage 9, only the cage in the section 5c being shown in FIG. 1. Each cage 9 has an arcuate outer wall 9A which substantially conforms to and faces the associated door, two angled back walls 9B which are nearly parallel to the partition members 7, and two side walls 9C which connect the outer and back walls.

FIG. 1A shows the stationary framework of the system, which is installed in the space of a building. The circular frames 4 are provided at vertically spaced intervals in the building and are interconnected by the three angularly spaced support columns or legs 70. The members 7 extend horizontally between the legs 70 and the central post 8 at the locations of the frames 4. As shown in FIG. 1B, each circular frame 4 has a circular flange 4*a* extending upwardly, and the legs 70 are secured to the flanges. As shown in FIG. 4A, the stationary 10 framework is also reinforced by additional rings 92 secured to the legs 70.

Two rotatable screws 10 are mounted vertically on each side wall 9C of each elevator cage 9, and engage short, flanged roller units 12 which are installed vertically inside each space section and which are supported by anchor-shaped members 11 secured to the stationary partition members 7. A preferred mechanism including the screw and flangled roller unit is disclosed in the applicant's U.S. Pat. No. 4,763,539 dated Aug. 16, 1988. These roller units 12 have peripherally mounted multiple disc-shaped flanges, with two roller units comprising one set, and, as shown in FIG. 2A, multiple roller units are arranged vertically with alternating link members 13.

As shown in FIG. 1, guide rails 14 extending from the bottom to the top of each space section 5A–5C are installed vertically on each side of the partition members 7 close to the central shaft 8, and a total of four grooved rollers 15, one each at the upper and the lower part of each side 9B, engaging the corresponding left and right rails 14, are mounted on the cage 9. Doors 16 are provided in the outer wall 9A of the cage 9, and the operation of these doors 16 matches that of the aforementioned doors 6, whereby persons or equipment may move in and out of the cages 9.

Figure 2A:
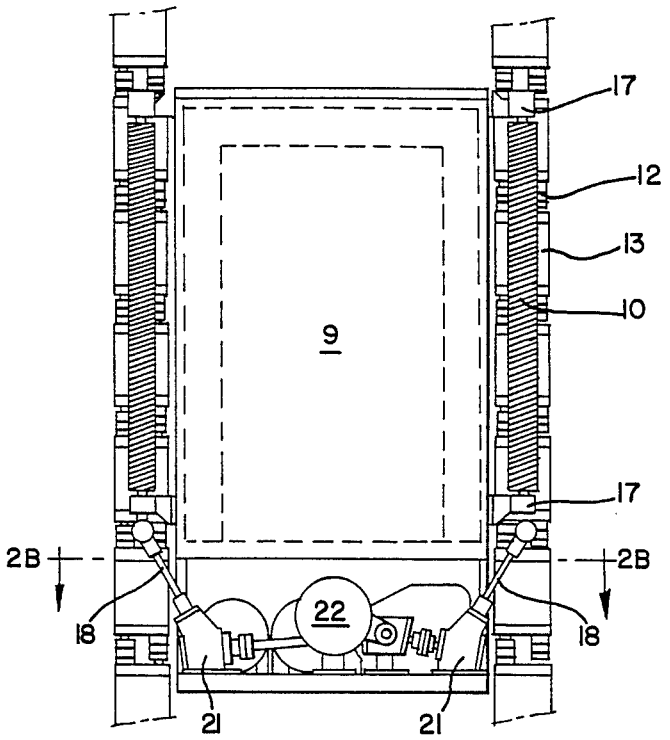
FIG. 2A shows a front view of an elevator cage of the system.
Figure 2B:
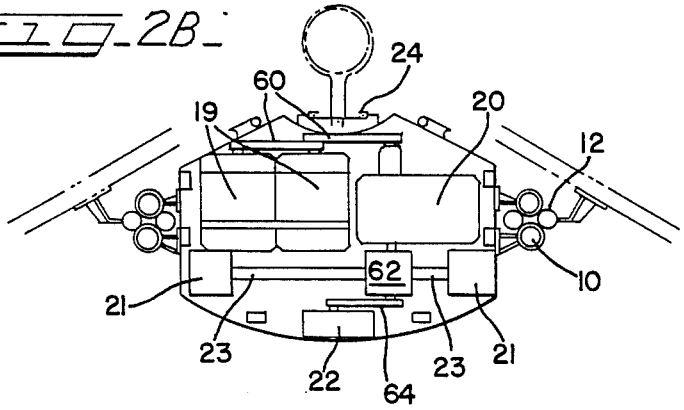
FIG. 2B shows a cross section cut along plane 2B—2B in FIG. 2A.

In FIGS. 2A and 2B, the screws 10 are supported at the top and bottom of the cage 9 by bearings 17. Power is transmitted to the screws 10 from a power compartment located at the bottom of the cage, more specifically, through a power line 10 24, two AC motors 19, belts 60, a stepless transmission 20, bevel gears 62, shafts 23, bevel gears 21, and ball-joint shafts 18. The rotation of the shafts 23 can be restrained through a belt 64 by a slide brake 22, shown in detail in FIG. 5.

Figure 3:
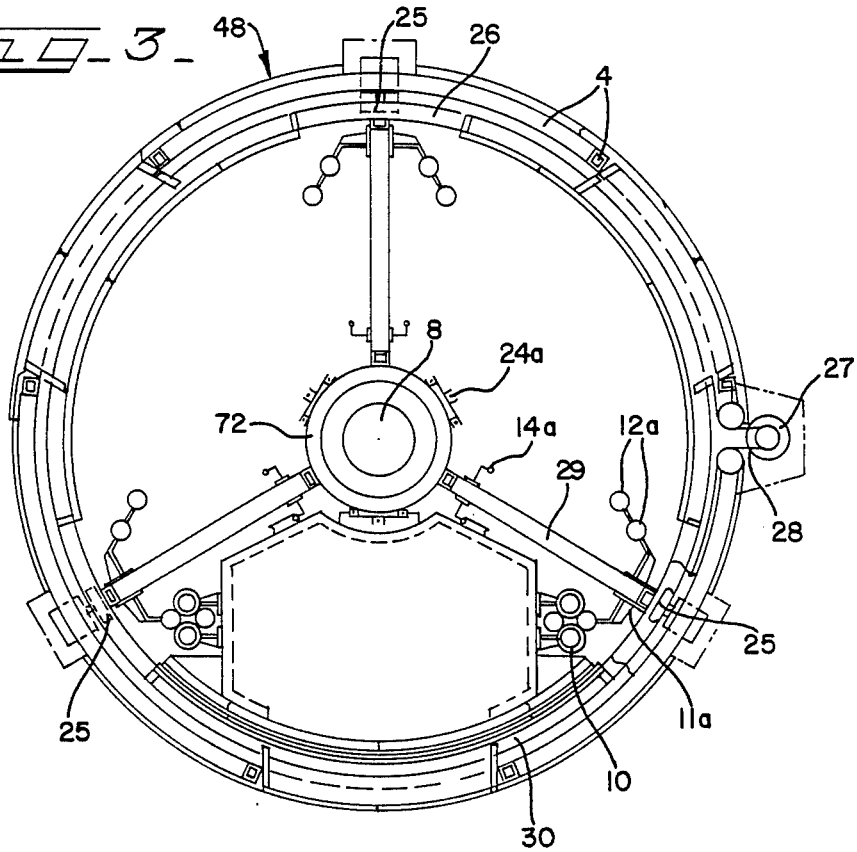
FIG. 3 shows a plan view of a cage transfer table of the system.

As shown in FIG. 4, a cage transfer table or turntable 48 is positioned between two adjacent rings 4 of the stationary framework. As shown in FIGS. 3, 4 and 4*a*, the turntable 48 includes a movable frame unit having an outer pair of upper and lower rings 26, an inner pair of upper and lower rings 72 journalled on the stationary framework by thrust bearings 74 supported on the central post 8, three pairs of upper and lower radial arms 29 bridging the rings 26 and 72, and two pairs of inner and outer pillars 76 and 78 bridging the upper and lower rings and arms.

Figure 3B:
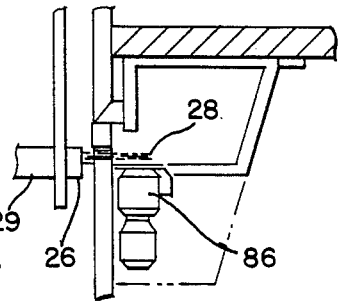
FIG. 3A shows a drive and limit stops of the transfer table.
Figure 3A:
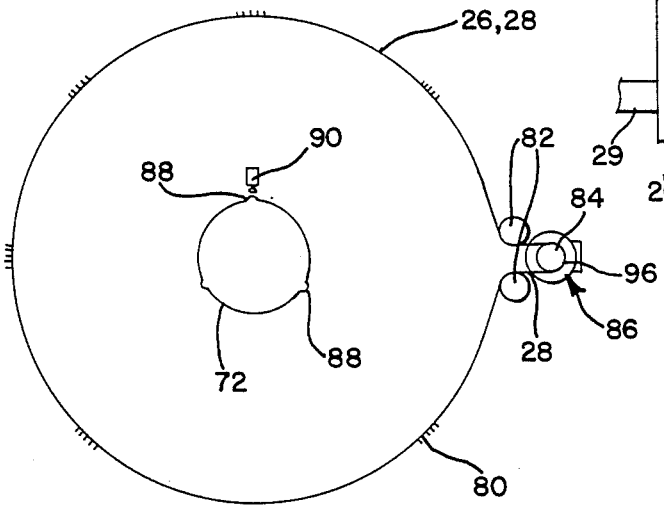

The lower outer ring 26 is rotatably supported by idler rollers 25 on the stationary framework and, as shown in FIG. 3*a*, the ring 26 has angularly spaced groups of outer peripheral teeth 80 for engagement with a chain 28. This chain engages tensing sprockets 82 and a sprocket 84 driven by a gear motor 86 (FIG. 3B) mounted on the building.

As shown in FIG. 3A, one inner ring 72 of the turntable has three cams 88 at angularly regular intervals for engagement with a limit switch 90 mounted on the stationary framework. Once the motor is energized, the turntable is rotated until a cam 88 engages the switch 90 and stops the rotation of the turntable by the brake as of the motor 86, at the location where the cage is aligned with one of the spaces 5A–5B.

With reference to FIGS. 4A–4C, each anchor-shaped support member 11*a* is supported by the horizontal pins 38 and is slidable along them within the member 37. The support 11*a* has two vertical hollow cylinders 39 on both ends for engagement by the pins 36 and 34. The pins 34 and 36 are movable by pneumatic cylinders 33 and 35 into the cylinders after the turntable has stopped rotating. Because of the slidable support of the cylinders 39, even if the radial arms 29 of the turntable are not precisely aligned with the stationary arms 7, the pins 34 on these arms 7 can enter the cylinders 39 to vertically align the flanged roller units 12 and 12*a*.

As shown in FIG. 4, there is also an assembly similar to that shown in FIG. 4A at the upper end of the turntable, where the lower ends of roller units 12 of the stationary framework are supported slightly slidably by means such as horizontal pins 38, and the upper ends of roller units 12*a* of the turntable are supported stationarily.

With reference to FIGS. 3, 4 and 4A, gate-shaped members 29 are mounted between the turntable frame unit 26 and the central shaft 8. The flanged roller units 12*a*, guide rails 14*a*, power line 24*a*, and gate-shaped members 29 inside this cage transfer table all revolve together with the turntable frame unit 26. These roller units 12*a* are also in sets of two, arranged vertically alternating with link members 13*a* as previously described, and are formed with multiple peripherally mounted disc-shaped flanges in order to enable them to engage the screws 10. These roller units 12*a* are supported by the left and right projections of anchor-shaped members 11*a* which are supported on the gate-shaped members 29. This cage transfer table also has doors 30 synchronized with the aforementioned doors 16.

FIG. 4A shows a flanged roller unit positioning device for the cage transfer table 48. Two guides 32 are mounted on each of the partition members 7 inside the cylindrical space 5, and the pointed-tip pin 34 is provided inside each of these guides 32. The air cylinders 35 are also mounted on each gate-shaped member 29 of the cage transfer table, and to each of these air cylinders 35 is mounted a pointed-tip pin 36 which is movable vertically by the associated air cylinder.

FIG. 5 shows the slide brake 22, and the principles of this brake are similar to those of the clutch apparatus described in the applicant's pending U.S. Pat. application Ser. No. 212,925 filed June 29, 1988, now abandoned. The brake 22 is located in the compartment at the bottom of a cage (see FIGS. 2A and 2B).

A brake shaft 40 connected to the transmission shaft 23 (FIG. 2B) is supported by two bearings 41. An involute spline is formed along the midsection of this brake shaft, and into the grooves of this spline are engaged a disc 42 which has one convex side and multiple thin discs 43 which are arranged so that they are movable axially. Spline grooves are formed on the inner surface of a brake cylinder 44, and into these spline grooves are engaged a disc 45 which has a concave side capable of making contact with the convex part of disc 42 and multiple thin discs 46 which are arranged alternately with thin discs 43 and which are movable axially. The cylinder 44 is connected through a rod 66 to a brake lever (not shown).

FIG. 7A shows a prior art elevator system in a, for example, twenty-story building. Four elevator shafts are shown and one cage in each shaft, each cage being suspended by a cable from a winding drum.

The following is a description of the operation of this embodiment of the invention. The description deals with the installation of the elevator system according to this invention in a 20-story building. If the system is installed on a high-rise building of more than 20 stories, the only difference is that the number of cage transfer tables at intermediate floors and the number of elevator cages in operation will increase.

In FIG. 7B, cage transfer tables 48 (FIGS. 3 and 6) are located at the top, bottom, and 10th floors of a 20-story building, cage stock or storage tables 49 (FIG.. 6) are located above the top floor and below the bottom floor, a repair room 50 (FIG. 7B) is located below the bottom floor, and it is possible to interchangeably transfer the cages between this repair room 50 and the lowest cage stock table 49.

In FIG. 7B, there are shown a total of 10 elevator cages represented by the boxes with crosses in them. Three passages or elevator sectors are indicated from left to right as $P_1$, $P_2$, and $P_3$. The three passages $P_1$, $P_2$, and $P_3$ are angularly spaced and correspond to the three spaces 5A, 5B and 5C shown in FIG. 1, for example. The cage which is traversing passage $P_1$ and which has reached the intermediate transfer table 48 is indicated as $K_1$. In this example, the transfer table 48 is located at the tenth floor.

If this cage $K_1$ is to be transferred by the transfer table 48 from passage $P_1$ to $P_2$, the turntable frame unit 26 is revolved, as shown in FIG. 3, and at the same time, the flanged roller units 12*a*, the guide rails 14*a*, the power lines 24*a*, and the gate-shaped members 29 also revolve. Then, this revolving movement stops (due to the limit switch 90) at the position at which the flanged roller units 12*a* of the transfer table 48 align with the flanged roller units 12. The positions of these limit switches are determined so that the rotation stops when the centers of the roller units 12 and 12*a* are approximately aligned.

Next, as shown in FIGS. 4A and 4B, the air cylinders 33 actuate the pins 34 to shoot through the guides 32, and the pointed tips of the pins enter the pin boss holes 39. Through this entrance of the four pin boss holes 39, two each on the bottom of the gate-shaped members 29 on the left and right of the cage, the flanged roller units 12*a* and 12 become perfectly aligned, and the elevator is secured in place the pins 34 in the pin boss holes thus forming clamp means 95. At this position the doors 6, 16, 30, and 31 may open and close, and boarding and deboarding of the elevator takes place. When the turntable frame unit 26 revolves, the pins 34 are retracted by the reverse action of the air cylinders 33, and, because the air cylinders 35, two of which are mounted on each of the gate-shaped members on the left and right of the cage, cause the pins 36 to enter the pin boss holes 39, the cage is secured so that there is no instability even while it is revolving.

Next, as shown in FIGS. 2A and 2B, the drive motors 19 turn, and that power is transmitted to the screws 10 located on the two sides of the elevator cage 9. Then, as shown in FIGS. 1 and 2A, the screws 10 move vertically while engaged with the flanged roller units 12, which makes it possible for the cage to ascend or descend.

When the cage arrives at a floor selected by a passenger, the disc 45 (FIG. 5) of the brake, having a concave surface which is engaged with the inner surface of the brake cylinder 44 and the disc 42 having a convex surface which is engaged with the brake shaft 40 make contact with each other, and the action of the resultant horizontal component force causes the thin discs 43 and 46 to be pressed together which activates the brake. Because this braking power acts upon the transmission shaft 23 (FIG. 2B) via the brake shaft 40, the cage soon stops, the doors 6 and 16 open, and the passenger can deboard.

This braking power can be freely adjusted by adjusting a spring 47 (FIG. 5) and, because operation is controlled by the contact of the curved sides of the discs, the wedging action allows braking to be accomplished with relatively little operating force. Moreover, because the contact of the curved surfaces ensures a large contact surface, the pressure load per unit of area is low, there is little chance of problems occurring from heat build-up, abrasion, etc., and it is also possible to operate the cage partially braked for extended periods of time, thus providing ideal control of the speed of the cage.

FIG. 7C shows a prior art elevator system for a thirty-story building, including four elevator shafts and a cage in each. FIG. 7D shows a system according to this invention for a thirty-story building. Two intermediate turntables 48 are provided, whereby there are turntables at ten-story intervals. The construction and operation is otherwise the same as described in connection with FIG. 7B.

If the traffic load is large, cages stocked in the stock tables 49 can be supplied, and, conversely, if the traffic load decreases, the unneeded cages can be restocked in the stock tables 49. In addition, malfunctioning cages can be repaired in the repair room 50 below the bottom floor, apart from the overall operation of the elevator system.

The stock tables 49 have the same construction as the transfer tables 48, and the transfer of cages between the stock tables 49 and the transfer tables 48 is accomplished by the same mechanism as that just described.

With the elevator system of this invention, because cage transfer tables are located at the bottom and top floors, and at an appropriate floor in between, and because the cage stock tables are located above the top floor and below the bottom floor, the cages stocked in the stock tables can be supplied continuously during periods of peak elevator use, and unneeded cages can be returned to the stock tables during periods of slack elevator use. When a cage reaches a floor at which a transfer table is located, it can be transferred to a different passage by that table. Furthermore, the transfer tables can be used as standby positions for empty cages; in this case, when a cage carrying passengers approaches, the empty cage is transferred to a different passage by the transfer table, thus avoiding any hindrance to the operation of the cage which is carrying passengers.

With this invention, it is possible for multiple elevator cages to traverse a cylindrical space, the cages can be supplied from or stocked in cage stock tables in accordance with the traffic load, and, by transferring stopped cages to different passages inside the cylindrical space, it is possible for other cages to pass those stopped cages. Thus, by using a computer to control the overall operation, it is possible to achieve efficient operation of the cages. In other words:

(1) The waiting time can be reduced to less than that for a conventional elevator system.

(2) If the same traffic capacity is to be maintained, it is possible to reduce the amount of space required for installation of the elevator system, thus allowing the business or living space of the building to be increased. Also, if the existing building business or living space is considered satisfactory, then the traffic capacity can be increased.

(3) Inspection and maintenance of the cages can be performed in a separate repair room without necessitating the closure of the passages.

(4) As shown in the following Tables 1 and 2, the elevator system of this invention is especially advantageous when used in high-rise buildings of approximately 30 stories.

TABLE 1

(20-story building)

| Type | Cage Capacity | Speed | No. of Cages | Operation Interval | Traffic Capacity (pass./5 min/cage) |
|---|---|---|---|---|---|
| Conventional | 8 passengers | 150 m/min | 4 | 14.87 sec | 161 |
| This invention | 8 passengers | 150 m/min | 10 | 5.95 sec | 403 |

TABLE 2

(30-story building shown in FIG. 7D)

| Type | Cage Capacity | Speed | No. of Cages | Operation Interval | Traffic Capacity (pass./5 min/cage) |
|---|---|---|---|---|---|
| conventional | 8 passengers | 150 m/min | 4 | 21.47 sec | 111 |
| This invention | 8 passengers | 150 m/min | 13 | 6.60 sec | 363 |

Premises (1) The height of one story is 3.3 m.
(2) Boarding time is omitted.
(3) Four conventional type elevator cages can be installed in the building.

What is claimed is:

1. An elevator system for use in a multi-story building, the building having a vertical space formed therein, said elevator system comprising a stationary framework adapted to be mounted in said space, said framework comprising frame members dividing said vertical space into a plurality of angularly spaced sectors, at least one elevator cage in each of said sectors, at least one turntable means rotatably mounted in said space adjacent said stationary framework, said turntable means being located to receive a cage from said stationary framework and rotate said cage from one of said sectors to another of said sectors, and power means on said frame members, said turntable means and each cage for moving each cage in the vertical direction.

2. An elevator system according to claim 1, and further including clamp means for holding said turntable means against rotation.

3. An elevator system according to claim 1, wherein said turntable means are located at the top, at the bottom, and at an intermediate level of said stationary framework.

4. An elevator system according to claim 1, wherein said power means includes a rotatable screw on a cage and a motor on said cage for rotating said screw, and roller means engageable with said screw and mounted on said stationary framework and on said turntable.

* * * * *